United States Patent [19]

Sundahl

[11] Patent Number: 4,667,348

[45] Date of Patent: May 26, 1987

[54] CYCLIST'S HELMET AND FACE MASK

[75] Inventor: James G. Sundahl, Irvine, Calif.

[73] Assignee: Bell Helmets, Inc., Norwalk, Calif.

[21] Appl. No.: 846,202

[22] Filed: Mar. 31, 1986

[51] Int. Cl.[4] ..... A42B 3/02

[52] U.S. Cl. ..... 2/410; 2/424; 2/425

[58] Field of Search ..... 2/410, 425, 424

[56] References Cited

U.S. PATENT DOCUMENTS

| | | | |
|---|---|---|---|
| 3,214,767 | 11/1965 | Weber | 2/9 |
| 3,774,239 | 11/1973 | Kotzar | 2/10 |
| 3,797,042 | 3/1974 | Gager, Jr. | 2/10 |
| 4,083,065 | 4/1978 | Warncke | 2/424 |
| 4,117,553 | 10/1978 | Bay | 2/10 |
| 4,210,972 | 7/1980 | Baclit | 2/10 |
| 4,475,254 | 10/1984 | Bay | 2/424 |

FOREIGN PATENT DOCUMENTS

| | | | |
|---|---|---|---|
| 3233467 | 3/1984 | Fed. Rep. of Germany | 2/410 |
| 3313308 | 10/1984 | Fed. Rep. of Germany | 2/410 |
| 1576410 | 10/1980 | United Kingdom | 2/410 |

*Primary Examiner*—Louis K. Rimrodt

*Attorney, Agent, or Firm*—William W. Haefliger

[57] ABSTRACT

A motorcyclist or bicyclist helmet has dome shaped top wall structure, side wall structures, a front opening for forward viewing, a shield covering said opening, a lower front wall structure, and rear wall structure. It also includes:

(a) frontward facing air inlet defined by the front wall structure, and (b) a face mask carried by the helmet to extend in upright relation inwardly of the lower front wall structure and configured to deflect air received through the air inlet for flow upwardly at the inner side of the shield, and to deflect the helmet wearer's breath away from the shield.

8 Claims, 7 Drawing Figures

CYCLIST'S HELMET AND FACE MASK

BACKGROUND OF THE INVENTION

This invention relates generally to helmets, and more particularly to a safety helmet of the type worn by motorcyclists and bicyclists, and having construction enhancing ventilation, eye shielding, anti-fogging, stability and comfort of the helmet, as worn.

In the past it was known to provide air vents in helmets, as for example are described in U.S. Pat. No. 3,496,854 to Feldman and U.S. Pat. No. 3,925,821 to Lewicki. Such helmets lack the unusually advantageous features of construction, modes of operation and beneficial results as are now provided in the present helmet, including air inlet flow control, both quantitatively and directionally, and face mask position control and in cooperation with air flow control, to deflect the wearer's breath downwardly, and to channel entering air to de-fog a face shield.

SUMMARY OF THE INVENTION

It is a major object of the invention to provide an improved safety helmet incorporating the above unusual advantages, singly and in combination, and results. Fundamentally, the helmet incorporates a dome shaped top wall structure, opposite side wall structures, a front opening for forward viewing, a rear wall structure, and in some cases a lower front wall structure which extends forwardly.

It is one major object of the invention to provide, in this helmet environment:

(a) frontward facing air inlet means defined by said front wall structure, and (b) a face mask carried by the helmet to extend in upright relation inwardly of said lower front wall structure and configured to deflect air received through said air inlet means for flow upwardly at the inner side of the shield, and to deflect the helmet wearer's breath away from the shield.

As will be seen, the inlet means may be located in the lower front wall structure, to direct entering air flow to mask channeling which receives air inflow and deflects it upwardly. To aid such flow, the shield and helmet top-wall structure define an opening via which said air flowing upwardly at the inner side of the shield is exhausted from the helmet via said opening.

It is another object of the invention to provide for movable, and/or removable anchoring of the face mask, as by means of a face piece defining a through opening portion of said air inlet, the channeling received in the through opening and opening forwardly. The face mask typically has two side flanges and a web interconnecting said flanges, thereby to define said channeling, the flanges projecting forwardly in the through opening, and therebeing side tongues on tne flanges retaining the face mask to the forward side of the face piece, adjacent the through opening. Further, the face mask may include a lower flange extending between the side flanges, and a downwardly projecting lower tongue on the lower flange retaining the mask to the forward and lower side of the face piece, adjacent the through opening.

It is a still further object of the invention to provide a face mask which has an upper portion spaced rearwardly of the face piece and projecting upwardly and downwardly to deflect the wearer's breath downwardly, as described, and to deflect air received through the air inlet for flow upwardly, as described. The transparent wind shield typically extends crosswise of the first opening in the helmet, the upper portion of the face mask also projecting rearwardly of the shield and spaced therefrom to guide entering air adjacent the inner side of the shield.

Air flow control may be attained by inclusion or non-inclusion of a reticulated foam piece in the air inlet to the face mask.

These and other objects and advantages of the invention, as well as the details of an illustrative embodiment, will be more fully understood from the following specification and drawings, in which:

DRAWING DESCRIPTION

DETAILED DESCRIPTION

Figure 1:
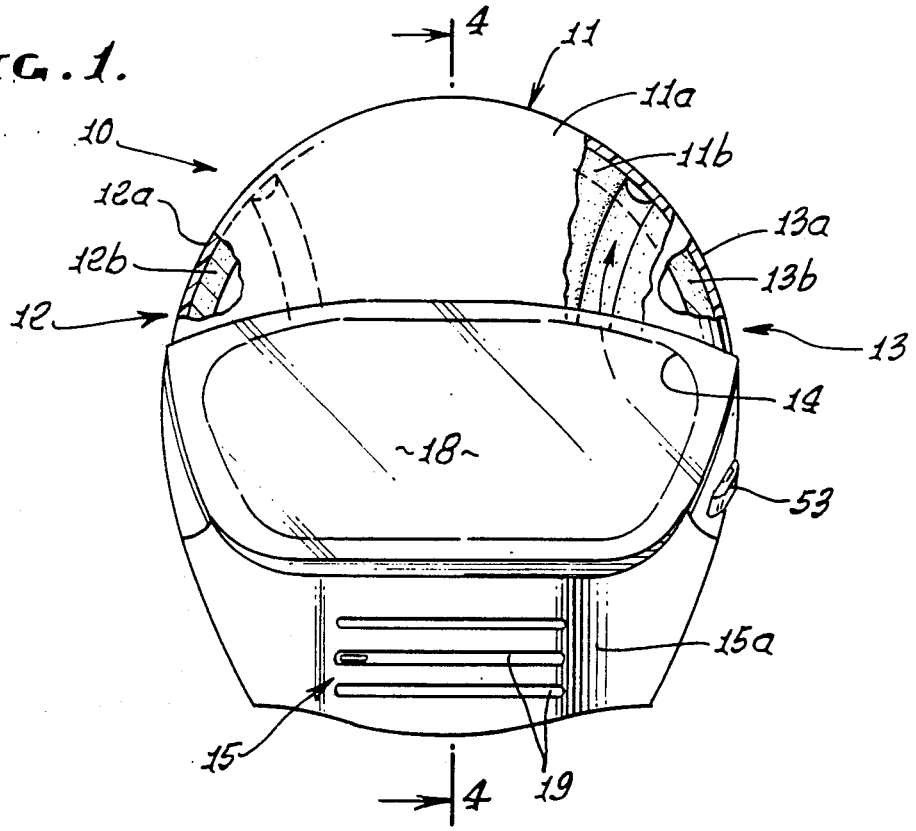
FIG. 1 is a front elevation showing a helmet incorporating the invention.
Figure 2:
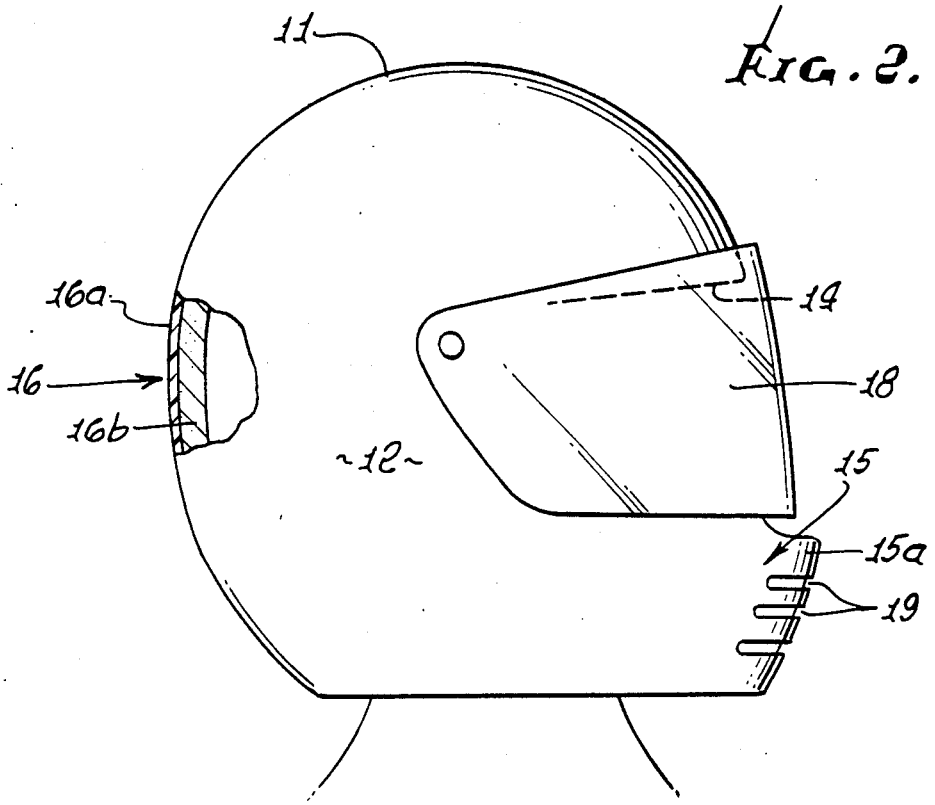
FIG. 2 is a left side elevation showing the FIG. 1 helmet.
Figure 3:
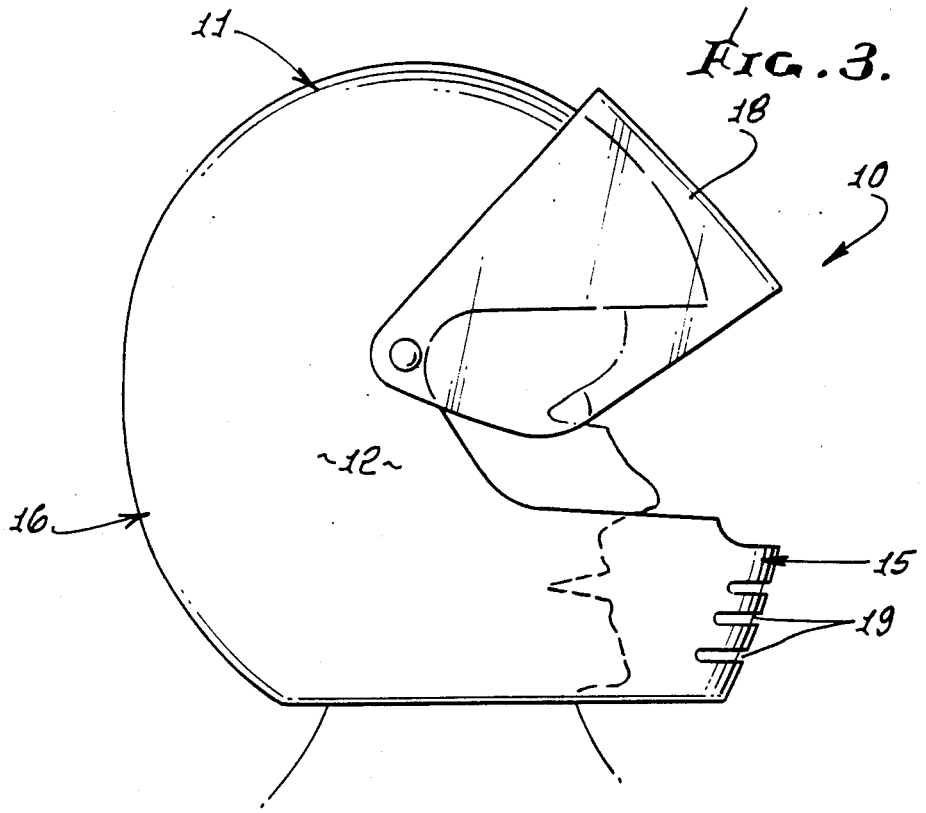
FIG. 3 is a view like FIG. 2, but showing the wind shield elevated.

In FIGS. 1, 2 and 3, the helmet 10 is shown as of the type worn by bicyclists and motorcyclists. It has a dome shaped top wall structure 11, opposite (left and right) side wall structures 12 and 13, a front opening 14 to enable forward viewing, a lower front portion 15 which juts or projects forwardly generally beneath the front opening 14, and rear wall structure 16, all as illustrated, for example. Such wall structures may be defined by an outer shell, and also (at certain locations) by an inner liner, with corresponding walls 11*a*, 11*b*; 12*a*, 12*b*; 13*a*, 13*b*; 15*a*; and 16*a* and 16*b*. The thin outer shell may consist of laminated, hard plastic material (polycarbonate), and the liner may consists of softer, molded plastic material such as rigid foamed plastic (polyurethane).

A frontwardly facing air inlet means is defined by the front wall structure 15 to receive air inflow for circulation to different portions of the helmet interior and subsequent flow to the helmet exterior. The inlet means is depicted by horizontal slits 19 through shell wall 15*a*, and from which inflowing air is directed upwardly, in a manner to be explained, toward the inner side of a shield 18 carried by the helmet. One purpose is for defogging the shield (i.e. removing condensation on the shield of moisture from the user's breath).

FIG. 2 shows the transparent plastic shield panel 18 as wrapping about the helmet forward extent, and as carried by the helmet to have multiple positions. The shield has a downwardly closed position in which the shield extends protectively across the helmet front viewing opening 14; also, the shield has a fully open position indicated in FIG. 3 in which the shield is fully elevated; and an intermediate position may be provided in which the shield is partly elevated. Moved to the latter position, the shield still protects the wearer's eyes from the full force of air impact. Suitable latching or detent means, indicated at 53, may be provided to retain the wind shield in any of said positions.

In one or more of such positions the shield is subject to fogging on its inner surface 18*a*, due to moisture from the warm breath of the cyclist condensing on that cooler surface, especially in cold weather.

Figure 4:
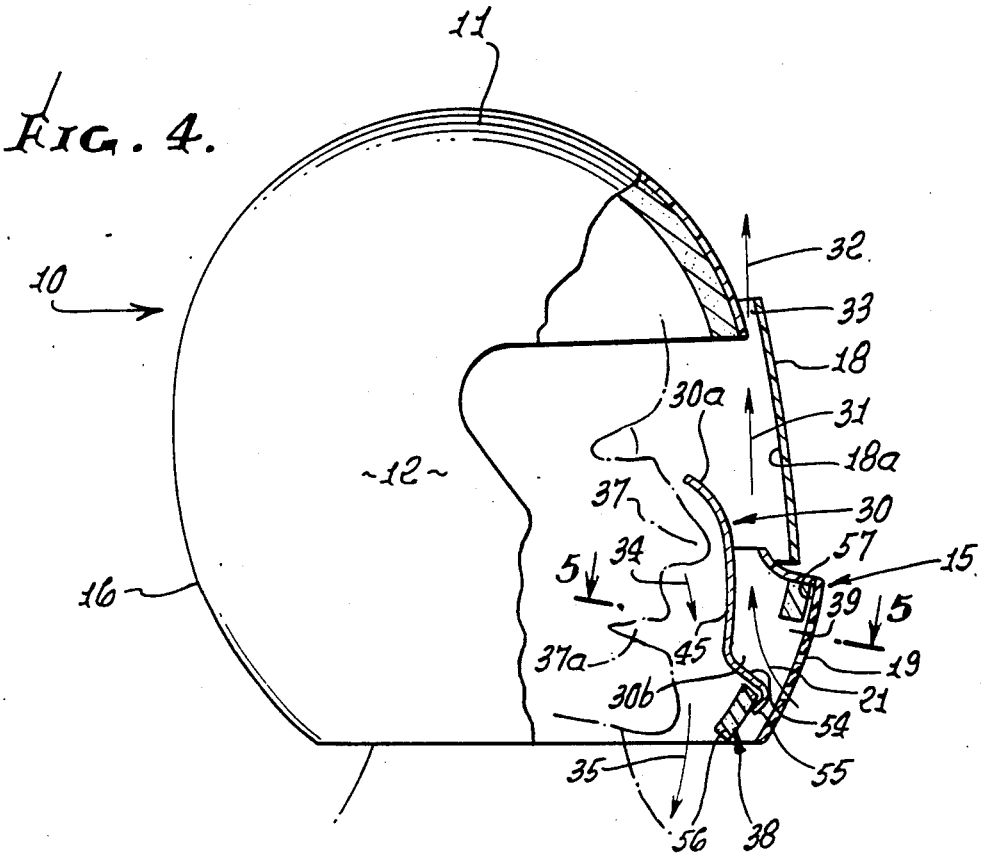
FIG. 4 is a side elevation, partly in section on lines 4—4 of FIG. 1, showing details of the face mask and its interfit in the helmet.
Figure 5:
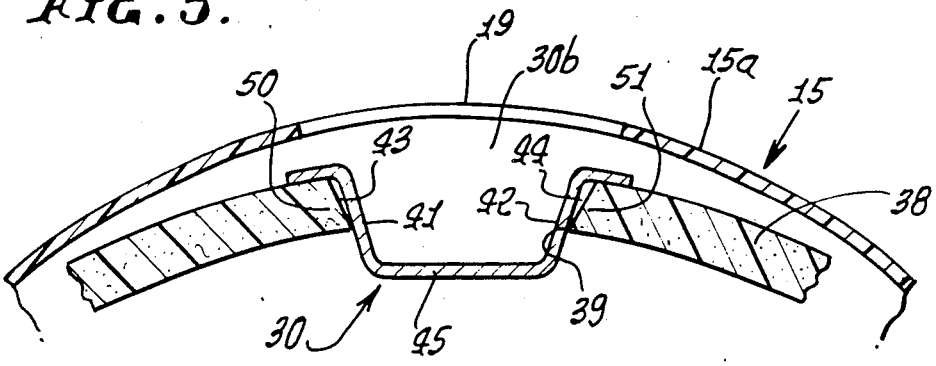
FIG. 5 is an enlarged section taken on lines 5—5 of FIG. 4.
Figure 6:
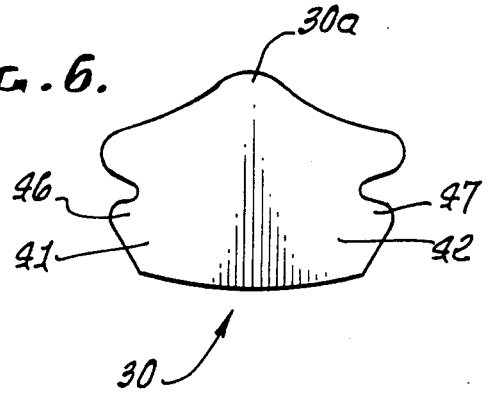
FIG. 6 is a plan view of a face mask incorporating the invention.

Referring to FIGS. 4 and 5, a face mask 30 is provided to be carried by and within the helmet to extend in upright relation inwardly of the lower front wall structure 15, the face mask being configured to:

(i) deflect outside air received through the inlet means 19 for flow upwardly at the inner side 18*a* of shield 18, (see arrows 31) thereby to prevent fogging of the shield, the air typically exhausting or being aspirated at 32 via opening 33 between the shield and helmet top; and (ii) deflect the helmet wearer's breath away from the shield, i.e. downwardly for example (see arrows 34), typically to exhaust from the helmet as at 35, via the open bottom of the helmet.

As will appear, the above functions are further aided by the loose adjustability of the face mask within the helmet, as by loose anchoring to helmet wall structure, to accomodate to the wearer's facial anatomy, i.e. nose 37, mouth 37*a*, etc. Note that the mask extends upwardly at 30*a* above the level of the nose 37.

More specifically, the mask has a lower edge portion extent movably retained or anchored by the inner liner, as for example liner face piece 38, to allow the mask to deflect or pivot relative to the liner, i.e. upper extent 30*a* may move forwardly or rearwardly to accomodate to the wearer's face. To this end, the face piece 38 typically defines a through opening 39 portion of the air inlet means, and channeling 30*b* defined by the mask is received in that opening, and opens forwardly and upwardly to receive air inflow via the air inlet means, (see arrows 21), and to deflect that air flow upwardly. In this regard, FIG. 5 shows the mask as having two rearwardly opening side flanges 41 and 42 fitting against the rearwardly tapering walls of the face piece opening at 43 and 44; and a rear web or cross piece 45 interconnecting the side flanges, and extending generally upwardly and spaced rearwardly of the face piece so as to deflect received air upwardly at 31 to flow at the rear of the face piece upper extend and at the rear of the shield 18, as previously described. Web 45 ultimately joins with the upper tongue extent 30*a* of the face mask. Sidewardly extending tongues 46 and 47 integral with the mask flanges overlap the face piece portions 50 and 51 to retain the mask to the face piece, adjacent the opening 39. The construction is such that the mask is easily removable from anchored position, as for cleaning.

The face mask also has an integral, downwardly projecting, lower flange 54 extending between the side flanges 41 and 42, in opening 39, and in addition a lower tongue 55 integral with flange 54 downwardly overlaps the face piece lower extent 56, adjacent opening 39, to aid in loose attachment or anchoring of the mask to the face piece. If desired, the mask may be more rigidly attached to the face piece, and the latter may be loosely retained in a well 57 formed by the helmet shell lower forward portion, to allow face mask adjustment, as described.

Figure 7:
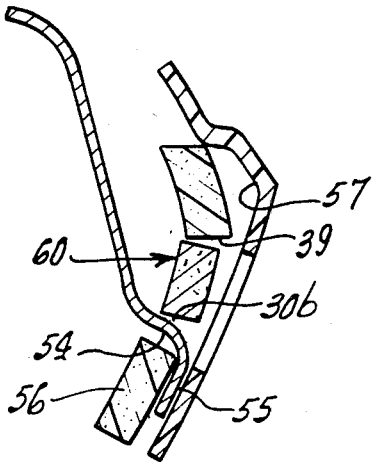
FIG. 7 is a fragmentary elevation, taken in section, showing a modification.

FIG. 7 shows removable reception of a reticulated foam piece 60 in the channel 30*b* formed by the face mask, and also within opening 39 formed by the face piece, the foam piece passing the air flow, but filtering same.

I claim:

1. In a motorcyclist or bicyclist helmet having dome shaped top wall structure, side wall structures, a front opening for forward viewing, a shield covering said opening, a lower front wall structure, and rear wall structure, the combination comprising:

(a) frontward facing air inlet means defined by said lower front wall structure, and (b) a face mask carried by the helmet to extend in upright relation inwardly of said lower front wall structure and defining channeling to deflect air received through said air inlet means for flow upwardly at the inner side of the shield, and to deflect the helmet wearer's breath away from the shield, (c) said top, side and rear wall structures being defined by an outer shell and an inner liner, said face mask having edge portion extent movably retained by said inner liner, to allow the mask to deflect relative to the liner, (d) said inner liner including a face piece located rearwardly of said lower front wall structure and defining a through opening portion of said air inlet means, said mask facing toward said through opening, whereby said channeling opens forwardly toward said through opening.

2. The combination of claim 1 including reticulated foam material in said air inlet.

3. The combination of claim 1 wherein said shield and the helmet top wall structure define an opening via which said air flowing upwardly at the inner side of the shield is exhausted from the helmet via said opening.

4. The combination of claim 1 wherein said face mask has two side flanges and a web interconnecting said flanges, thereby to define said channeling, said flanges projecting forwardly in said through opening, and there being side tongues on said flanges retaining the face mask to the forward side of the face piece, adjacent the through opening.

5. The combination of claim 4 wherein said face mask has two side flanges and a web interconnecting said flanges and extending rearwardly of said through opening, thereby to defined said channeling, said flanges projecting forwardly in said through opening, and there being a lower flange extending between said side flanges, and a downwardly projecting lower tongue on said lower flange retaining the mask to the forward and lower side of the face piece, adjacent the through opening.

6. The combination of one of claim 4 and 5 including reticulated foam material receive in said channeling, said material being removable.

7. The combination of claim 5 wherein the face mask has an upper portion spaced rearwardly of the face piece and projecting upwardly and downwardly to deflect the wearer's breath downwardly, as aforesaid, and to deflect air received through said air inlet for flow upwardly, as aforesaid.

8. The combination of claim 7 including a transparent shield extending crosswise of said front opening, said upper portion of the face mask also projecting rearwardly of the shield and spaced therefrom to guide entering air adjacent the inner side of the shield.

* * * * *